US005783978A

United States Patent [19]

Noguchi et al.

[11] Patent Number: 5,783,978

[45] Date of Patent: Jul. 21, 1998

[54] BAND REJECTION FILTER HAVING A PLURALITY OF DIELECTRIC RESONATOR WITH CUTOUT PORTIONS HAVING ELECTRODES THEREIN

[75] Inventors: Toshiharu Noguchi; Hiroshi Ono, both of Miyazaki-ken, Japan

[73] Assignee: Matsushita Electric Industrial Co., Ltd., Osaka, Japan

[21] Appl. No.: 665,712

[22] Filed: Jun. 18, 1996

[30] Foreign Application Priority Data

Jun. 21, 1995 [JP] Japan ..... 7-154335

[51] Int. Cl.[6] ..... H01P 1/205

[52] U.S. Cl. ..... 333/202; 333/206; 333/222

[58] Field of Search ..... 333/203, 206, 333/222, 202, 202 DB

[56] References Cited

U.S. PATENT DOCUMENTS 5,208,565 5/1993 Sogo et al. ..... 333/206

FOREIGN PATENT DOCUMENTS 576273 12/1993 European Pat. Off. ..... 333/206
801 1/1989 Japan ..... 333/206
4242301 8/1992 Japan ..... 333/206
5167308 7/1993 Japan ..... 333/206
5167309 7/1993 Japan ..... 333/206
6-13802 1/1994 Japan .
6276005 9/1994 Japan ..... 333/206

*Primary Examiner*—Benny Lee
*Attorney, Agent, or Firm*—Lowe Hauptman Gopstein Gilman & Berner

[57] ABSTRACT

A band rejection filter includes at least of two dielectric resonators and an inductor. Each dielectric resonator is composed of a dielectric base formed as a rectangular prism and having a penetrating hole in a central portion, an inner conductive layer arranged on an inner side surface of the dielectric base, an outer conductive layer arranged on an outer side surface of the dielectric base, a connecting conductive layer arranged on one end surface of the dielectric base to connect the outer conductive layer and the inner conductive layer, an outer conductor layer cut-out groove formed on the outer side surface of the dielectric base, and an independent coupling electrode surrounded by the outer conductor layer cut-out groove on the dielectric base. The inductor connects the independent coupling electrode of the dielectric resonators, and the outer conductive layers of the dielectric resonators are connected with each other. The outer conductor layer cut-out groove is surrounded by the outer conductive layer, thus avoiding change in a resonance frequency in the band rejection filter. The outer end surface of the dielectric base is opened and is surrounded by the outer conductive layer thus avoiding change in attenuation characteristics of the band rejection filter.

8 Claims, 9 Drawing Sheets

BAND REJECTION FILTER HAVING A PLURALITY OF DIELECTRIC RESONATOR WITH CUTOUT PORTIONS HAVING ELECTRODES THEREIN

BACKGROUND OF THE INVENTION

1. Field of the Invention

The present invention relates to a band rejection filter widely used for a communication apparatus in a portable telephone or a radio telephone.

2. Description of the Related Art 2.1. First Previously Proposed Art

FIG. 1A is an oblique view of a conventional dielectric resonator, FIG. 1B is a cross-sectional view taken generally along a line A—A of FIG. 1A.

As shown in FIGS. 1A and 1B, a conventional dielectric resonator 101 is composed of a dielectric base 102 made of a dielectric material and having a shape of a rectangular prism, a penetrating hole 103 placed in a central portion of the dielectric base 102, an outer conducting plate 104 arranged on an outer side surface of the dielectric base 102, an inner conducting plate 105 arranged on an inner side surface of the dielectric base 102, and a connecting conductive layer 106 (see FIG. 1B) arranged on one end surface of the dielectric base 102 for connecting the inner conducting plate 105 and the outer conducting plate 104. The other end surface of the dielectric base 102 is opened and is exposed to the air.

In the above configuration, a conventional band rejection filter in which three conventional dielectric resonators 101 arranged in parallel to each other are used is described.

FIG. 2 is a view of an equivalent circuit of a general band rejection filter.

As shown in FIG. 2, in an equivalent circuit of a general band rejection filter including a conventional band rejection filter, three dielectric resonator equivalent circuits DR are arranged in parallel to each other. Each equivalent circuit DR is expressed by a parallel circuit composed of an inductor and a capacitor. A coupling capacitor having a coupling capacitance Cc is connected with each dielectric resonator equivalent circuit DR, a coupling inductor having a coupling inductance Lc connects each pair of coupling capacitors Cc adjacent to each other, a grounded capacitor having a capacitance Ce is serially connected with each coupling capacitor Cc, and a pair of input/output terminals T respectively connected with the coupling capacitor Cc and the grounded capacitor Ce placed on one side of the equivalent circuit of the general band rejection filter for inputting/outputting a signal.

FIG. 3 is an exploded oblique view of a conventional band rejection filter.

As shown in FIG. 3, the three conventional dielectric resonators 101 are arranged in parallel to each other in a conventional band rejection filter 111. A central conducting plate 112 formed by solder-plating a phosphor bronze plate having a thickness of 0.15 mm is connected with each of the inner conductors 105 of the dielectric resonators 101. Each of the coupling capacitors of FIG. 2 is composed of a dielectric plate 113 made of a dielectric material, a first dielectric plate electrode 114 arranged on an upper surface of the dielectric plate 113 and a second dielectric plate electrode 115 arranged on a lower surface of the dielectric plate 113. The first dielectric plate electrode 114 is connected with each of the central conductors 112. An air-core coil 116 having the coupling inductance Lc of FIG. 2 connects the second dielectric plate electrodes 115 of each pair of coupling capacitors Cc adjacent to each other. A pair of input/output terminals 117 equivalent to the input/output terminals T of FIG. 2 are connected with the second dielectric plate electrodes 115 of the two coupling capacitors Cc placed on both end sides. Each of the input/output terminals 117 is formed by solder-plating a phosphor bronze plate having a thickness of 0.15 mm. Each of the grounded capacitors Ce of FIG. 2 is composed of a coupling base plate 118 made of a dielectric material, a coupling base plate electrode 119 arranged on an upper surface of the coupling base plate 118 and a grounded electrode 120 arranged on a lower surface of the coupling base plate 118. The coupling base plate electrode 119 is connected with each of the second dielectric plate electrodes 115. The conventional dielectric resonators 101, the coupling capacitor, the grounded capacitors and the input/output terminals 117 are arranged on a metal chassis 121 and are covered by a metal cover 122 formed by solder-plating a phosphor bronze plate having a thickness of 0.15 mm. The metal cover 122 functions as a shield.

2.2. Second Previously Proposed Art

Also, a coaxial resonator and a dielectric filter using the coaxial resonator are disclosed as a prior art in a Published Unexamined Japanese Patent Application No. 6-13802 of 1994.

FIG. 4 is a diagonal view of a conventional dielectric resonator.

As shown in FIG. 4, a conventional dielectric resonator 131 is composed of a dielectric base 132 made of a dielectric material and having a shape of a rectangular prism, a penetrating hole 133 placed in a central portion of the dielectric base 132, an outer conducting plate 134 arranged on an outer side surface of the dielectric base 132, an inner conducting plate 135 arranged on an inner side surface of the dielectric base 132, a connecting conductive layer 136 arranged on one end surface of the dielectric base 132 for connecting the inner conducting plate 135 and the outer conducting plate 134, and a pair of independent coupling electrodes 137 and 138 arranged on another outer side surface of the dielectric base 132. A capacitor is made of the pair of independent coupling electrodes 137 and 138, the inner conducting plate 135 and the dielectric base 132. The other end surface of the dielectric base 132 is opened and is exposed to the air.

2.3. Problems to be Solved by the Invention

However, in the first prior art, when the conventional band rejection filter 111 is manufactured, the coupling capacitor Cc and the grounded capacitor Ce arranged outside the dielectric resonators 101 are required, and there is a drawback that a small-sized band rejection filter cannot be manufactured.

Also, because the number of elements in the conventional band rejection filter 111 is high, there is another drawback that the conventional band rejection filter 111 cannot be manufactured at a low cost.

Also, because manufacture of the conventional band rejection filter 111 is complicated, there is another drawback that it is difficult to mass-produce the conventional band rejection filter 111.

Also, because the coupling capacitor Cc and the grounded capacitor Ce are required to be arranged outside the dielectric resonators 101, an electric field induced by the coupling capacitor Cc or the grounded capacitor Ce easily leaks, the dielectric resonators 101 are undesirably coupled with each other, and attenuation characteristics of the conventional band rejection filter 111 is degraded. In particular, because the leakage of the electric field corresponding to an electromagnetic wave is increased as a frequency of the electromagnetic wave is higher, attenuation characteristics of the conventional band rejection filter 111 for a high band wave is considerably degraded. To prevent the coupling of the conventional dielectric resonators 101, the metal chassis 121 and the metal cover 122 are required in the conventional band rejection filter 111, as shown in FIG. 3. Therefore, it is difficult to mass-produce the conventional band rejection filter 111.

In the second prior art, because the independent coupling electrodes 137 and 138 are formed on the outer side surface of the dielectric base 132, the outer conducting plate 134 is not formed on all outer side surface of the dielectric base 132. Therefore, a length of the conventional dielectric resonator 131 is substantially shortened.

In this case, when a dielectric resonator having no independent coupling electrode is resonated, a relationship between a length Lo (e.g., in mm) of the dielectric resonator and a resonance frequency Fo (e.g., in Mhz) is generally formulated as follows.

$$Fo=C/\{4(\epsilon Lo)^{1/2}\}$$

Here a symbol $\epsilon$ denotes a dielectric constant of the dielectric resonator, and a symbol C denotes a light velocity. Therefore, even though a dielectric resonator having no independent coupling electrode is resonated at the resonance frequency Fo on condition that a length of the dielectric resonator is Lo, the resonance frequency in the conventional dielectric resonator 131 having the same length Lo is higher than the resonance frequency Fo. To resonate the conventional dielectric resonator 131 at the same resonance frequency Fo, it is required to lengthen the conventional dielectric resonator 131. Therefore, there is a first drawback that a size of the conventional dielectric resonator 131 becomes large.

Also, because the other end surface of the dielectric base 132 is opened, any grounded surface current does not flow to the opened end surface, and an electromagnetic field leaks from the opened end surface of the dielectric base 132. Therefore, in cases where a plurality of conventional dielectric resonators 131 are arranged to make a band rejection filter, an unnecessary coupling occurs between the conventional dielectric resonators 131. Therefore, there is a drawback that attenuation characteristics of the band rejection filter is degraded.

SUMMARY OF THE INVENTION

An object of the present invention is to provide, with due consideration to the drawbacks of such a conventional dielectric resonator and a conventional band rejection filter, a dielectric resonator which is manufactured in a small size and has functions of a coupling capacitor and a grounded capacitor and a band rejection filter having a plurality of dielectric resonators which has a small number of elements and a simplified configuration and is easily mass-produced.

The object is achieved by the provision of a band rejecting filter comprising a plurality of dielectric resonators arranged in parallel to each other, each of the dielectric resonators comprising:

a dielectric base having a penetrating hole;

an outer conductor arranged on an outer side surface of the dielectric base, the outer conductors of a pair of dielectric resonators adjacent to each other being connected;

an inner conductor arranged on an inner side surface of the dielectric base to surround the penetrating hole;

a connecting conductor arranged on one end surface of the dielectric base for connecting the outer conductor and the inner conductor;

an outer conductor cut-out groove arranged on the outer side surface of the dielectric base to expose a part of the outer side surface of the dielectric base on which the outer conductor is not arranged; and an independent coupling electrode arranged on the outer side surface of the dielectric base to be surrounded by the outer conductor cut-out groove on condition that the independent coupling electrode is not connected with the outer conductor, and one or more inductor elements respectively connecting the independent coupling electrodes of the pair of dielectric resonators adjacent to each other.

In the above configuration, the inner conductor and the independent coupling electrode are arranged on both sides of the dielectric base to be opposite to each other. Therefore, a set of the dielectric base, the inner conductor and the independent coupling electrode functions as a coupling capacitor. Also, the independent coupling electrode and the outer conductor are arranged on both sides of the outer conductor cut-out groove to be opposite to each other. Therefore, a set of the outer conductor cut-out groove, the independent coupling electrode and the outer conductor functions as a grounded capacitor. Because the coupling capacitor and the grounded capacitor are formed in each of the dielectric resonators and one inductor element is arranged between the dielectric resonators adjacent to each other, the band rejection filter can be manufactured in a small size.

BRIEF DESCRIPTION OF THE DRAWINGS

The objects, features and advantages of the present invention will be apparent from the following description taken in conjunction with the accompanying drawing in which like numbers denote like elements throughout, wherein.

DETAILED DESCRIPTION OF THE EMBODIMENTS

Preferred embodiments of a dielectric resonator according to the present invention are described with reference to drawings.

Figure 5A:
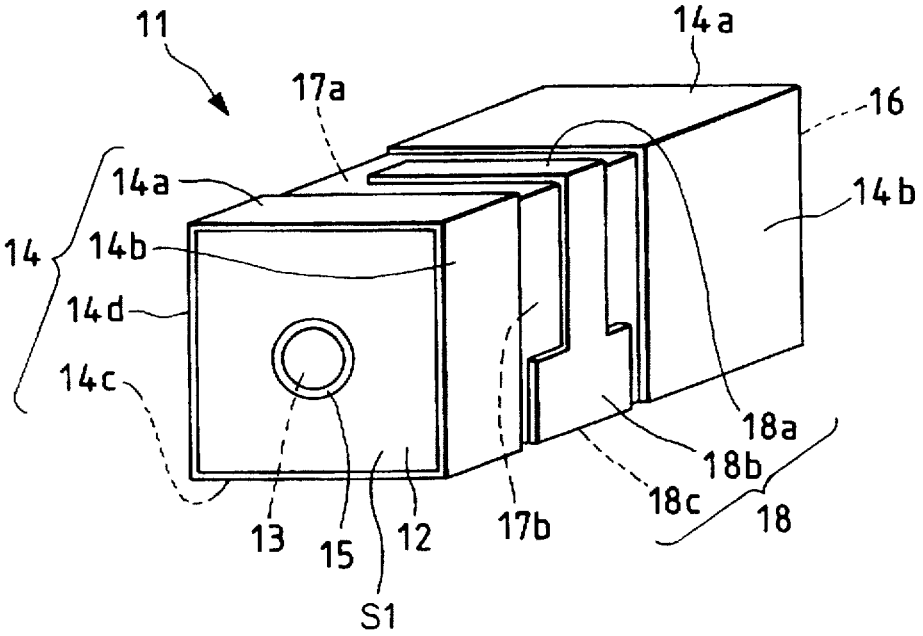
FIG. 5A is a diagonal view of a dielectric resonator according to a first embodiment of the present invention.
Figure 5B:
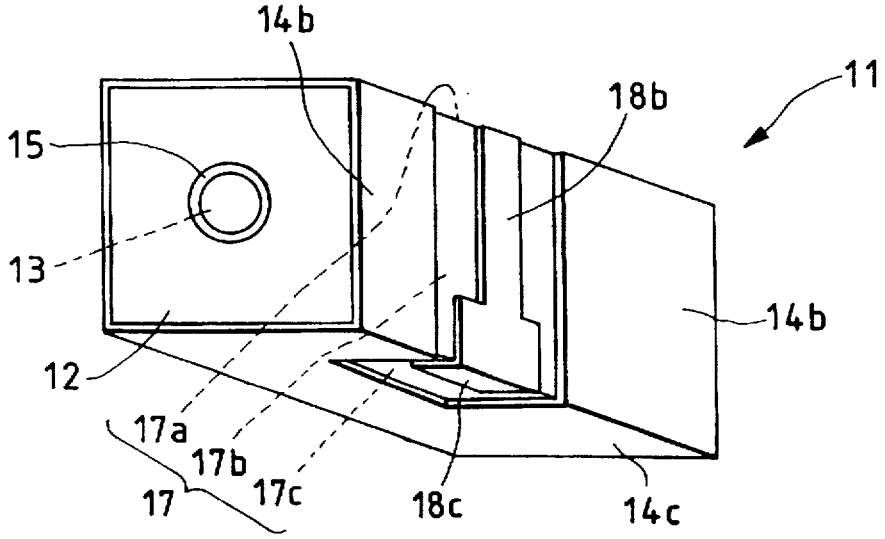
FIG. 5B is another diagonal view of the dielectric resonator shown in FIG. 5A.

FIG. 5A is a diagonal view of a dielectric resonator according to a first embodiment of the present invention. The dielectric resonator is viewed from an upper point. FIG. 5B is another diagonal view of the dielectric resonator shown in FIG. 5A. The dielectric resonator is viewed from a lower point.

As shown in FIGS. 5A and 5B, a dielectric resonator 11 comprises a dielectric base 12 made of a dielectric material and having a shape of a rectangular prism, a penetrating hole 13 extending from a center of one side end of the dielectric base 12 to a center of the other side end in a longitudinal direction of the dielectric base 12, an outer conductive layer 14 (see FIG. 5A) arranged on four outer side surfaces of the dielectric base 12, an inner conductive layer 15 arranged on an inner side surface of the dielectric base 12, a connecting conductive layer 16 arranged on one end surface of the dielectric base 12 (see FIG. 5A) for connecting the inner conductive layer 15 and the outer conductive layer 14, an outer conductor cut-out groove 17 (see FIG. 5B) arranged on three outer side surfaces of the dielectric base 12 for dividing the outer conductive layer 14 arranged on the three outer side surfaces of the dielectric base 12 into two portions arranged on both end sides of the dielectric base 12, and an independent coupling electrode 18 (see FIG. 5A) arranged on the three outer side surfaces of the dielectric base 12 to be surrounded by the outer conductor cut-out groove 17. The other end surface S1 of the dielectric base 12 is opened and is exposed to the air. The dielectric base 12 is exposed from the outer conductor cut-out groove 17 to the air.

The outer conductive layer 14 is partitioned into a first outer conductive layer **14*a* (see FIG. 5A) arranged on a first outer side surface of the dielectric base 12, a second outer conductive layer 14*b* arranged on a second outer side surface of the dielectric base 12 and connected with the first outer conductive layer 14*a*, a third outer conductive layer 14*c* (see FIG. 5B) arranged on a third outer side surface of the dielectric base 12 and connected with the second outer conductive layer 14*b*, and a fourth outer conductive layer 14*d* (see FIG. 5A) arranged on a fourth outer side surface of the dielectric base 12 and connected with the first and third outer conductive layers 14*a* and 14*c***.

The outer conductor cut-out groove 17 is partitioned into a first outer conductor cut-out groove **17*a* arranged on the first outer side surface of the dielectric base 12 to divide the first outer conductive layer 14*a* into two portions, a second outer conductor cut-out groove 17*b* arranged on the second outer side surface of the dielectric base 12 to divide the second outer conductive layer 14*b* into two portions, and a third outer conductor cut-out groove 17*c* (see FIG. 5B) arranged on the third outer side surface of the dielectric base 12 to divide the third outer conductive layer 14*c*** into two portions.

The independent coupling electrode 18 is partitioned into a first independent coupling electrode **18*a* (see FIG. 5A) arranged on the first outer side surface of the dielectric base 12 and placed in the first outer conductor cut-out groove 17*a*, a second independent coupling electrode 18*b* arranged on the second outer side surface of the dielectric base 12 and placed in the second outer conductor cut-out groove 17*b*, and a third independent coupling electrode 18*c* arranged on the third outer side surface of the dielectric base 12 and placed in the third outer conductor cut-out groove 17*c***.

In the above configuration, a manufacturing method of the dielectric resonator 11 is described.

Three original dielectric materials ($BaCO_3$, $TiO_2$ and $Nd_2O_3$) are mixed at a prescribed mixing ratio to produce a dielectric mixed material having a relative dielectric constant of 95, and the dielectric mixed material are wet-mixed for twenty-four hours by using a ball mill. Thereafter, polyvinyl acetate (PVA) organic binder is added to the dielectric mixed material to include the PVA organic binder in the amount of 3% by weight, a particle size of the dielectric mixed material is adjusted by using a spray dryer, and the dielectric mixed material is granulated. Thereafter, the granulated dielectric material is formed in a prescribed shape at a pressure of 700 $Kg/cm^2$ by using a dry press, the granulated dielectric material is sintered in the air of a furnace at temperatures ranging from 1300° to 1400° C., and the dielectric base 12 is formed in a rectangular prism to produce the penetrating hole 13. For example, a length of the dielectric base 12 in a longitudinal direction is 8 mm, width and height of the dielectric base 12 are respectively 3 mm, an a diameter of the penetrating hole 13 is 0.8 mm, and the relative dielectric constant is 95. Thereafter, a conductive film is formed on the surfaces of the dielectric base 12 according to one of various film forming methods. As a first film forming method, the formation of a conductive film made of copper is described.

The surfaces of the dielectric base 12 are processed by a barrel finishing machine or a blasting machine to make the surfaces uneven, a wet-etching process is performed for the dielectric base 12, and an uneven degree of the surfaces of the dielectric base 12 is adjusted to a value ranging from 5 to 9 μm. In this case, an etching liquid HF—$HNO_3$ is used. Thereafter, a sensitivity process is performed for all surfaces of the dielectric base 12 with stannous chloride, palladium functioning as catalytic metal is attached on all surfaces of the dielectric base 12, and a resist film is formed on a partial surface of the dielectric base 12. The partial surface on which the resist film is formed agrees with the outer conductor cut-out groove 17 on which any conductive layer or electrode is not arranged. For example, resist ink is coated on the partial surface of the dielectric base 12 according to a printing technique or a transferring technique, and the resist ink is dried and hardened to form the resist film. Thereafter, first thin copper films are formed on the remaining surfaces of the dielectric base 12 according to an electroless copper-plating method. In this case, any copper film is not coated on the resist film. Thereafter, second copper films are laminated on the first thin copper films according to an electrolytic copper-plating method, and conductive films are formed. In this case, a thickness of the conductive films is about 5 μm. Thereafter, the resist film is removed by using solvent, and the conductive layers 14, 15 and 16 and the electrode 18 are formed.

In this film forming method, the resist film is formed by coating a prescribed surface of the dielectric base 12 with the resist ink and drying and hardening the resist ink. However, it is applicable that photosensitive resist be used in place of the resist ink. That is, after catalytic metal such as palladium is attached on all surfaces of the dielectric base 12, all surfaces of the dielectric base 12 are coated with the photosensitive resist, a portion of the photosensitive resist coated on the partial surface of the dielectric base 12 is exposed to light, and the portion of the photosensitive resist is hardened, the other portion of the photosensitive resist not hardened is washed out by using a developer, and the conductive layers 14, 15 and 16 and the electrode 18 are formed.

In another film forming method, all surfaces of the dielectric base 12 are coated with an Ag paste liquid according to a printing or dipping method, the Ag paste liquid is dried, a thermal processing is performed for the dried Ag paste at temperatures ranging from 800° to 900° C., and a conductive film is formed on all surfaces of the dielectric base 12. After the formation of the conductive film, an unnecessary portion of the conductive film is removed according to an etching technique such as a chemical etching or a dry etching, and the conductive layers 14, 15 and 16 and the electrode 18 are formed.

In another film forming method, after the conductive film is formed on all surfaces of the dielectric base 12, an unnecessary portion of the conductive film is removed according to a cutting process, an ultrasonic process or a laser process, and the conductive layers 14, 15 and 16 and the electrode 18 are formed.

A function of the dielectric resonator 11 manufactured according to the above manufacturing method is described.

Figure 1A:
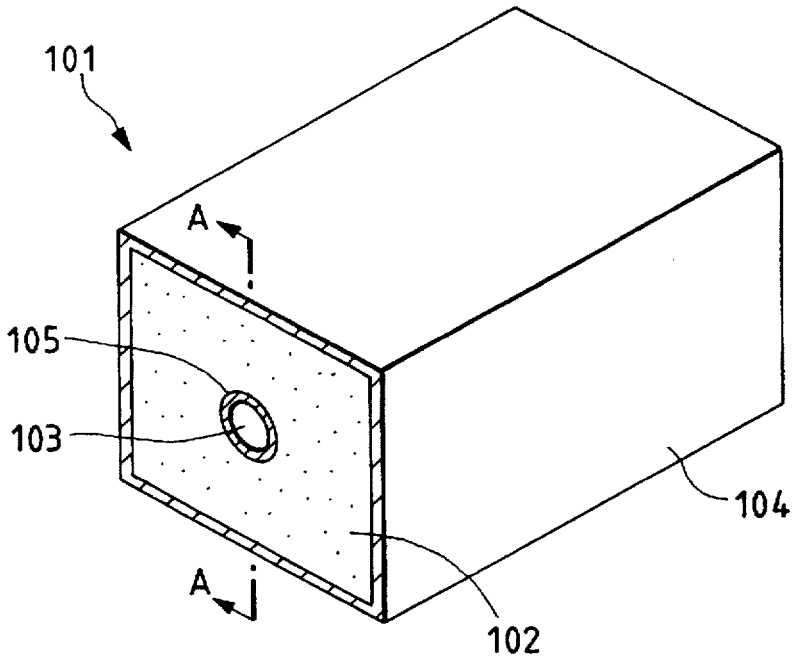
FIG. 1A PRIOR ART
FIG. 1A is an oblique view of a conventional dielectric resonator.
Figure 1B:
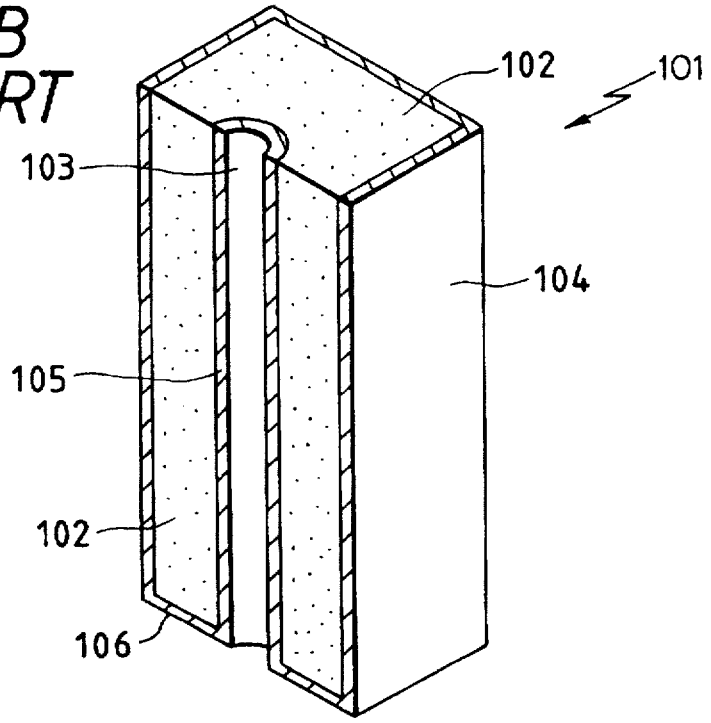
FIG. 1B PRIOR ART
FIG. 1B is a cross-sectional view taken generally along a line A—A of FIG. 1A.
Figure 2:
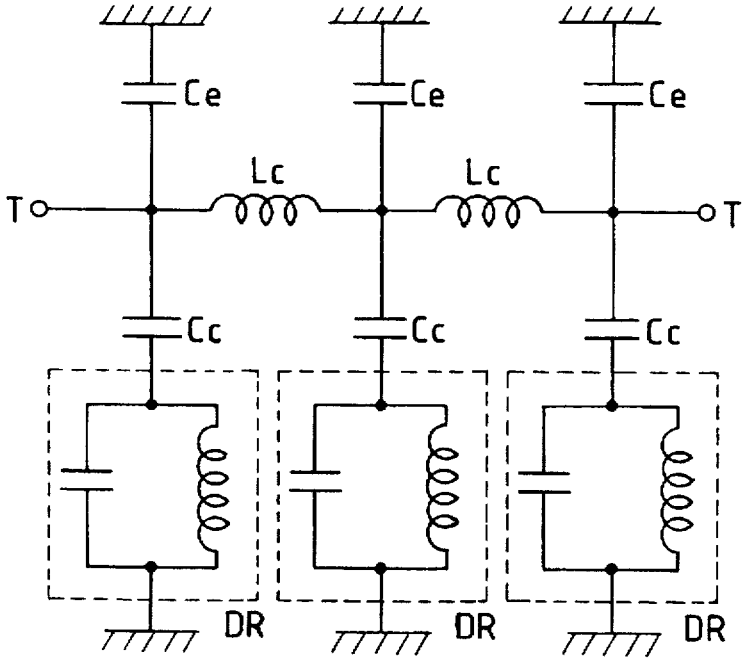
FIG. 2 PRIOR ART
FIG. 2 is a view of an equivalent circuit of a general band rejection filter.
Figure 4:
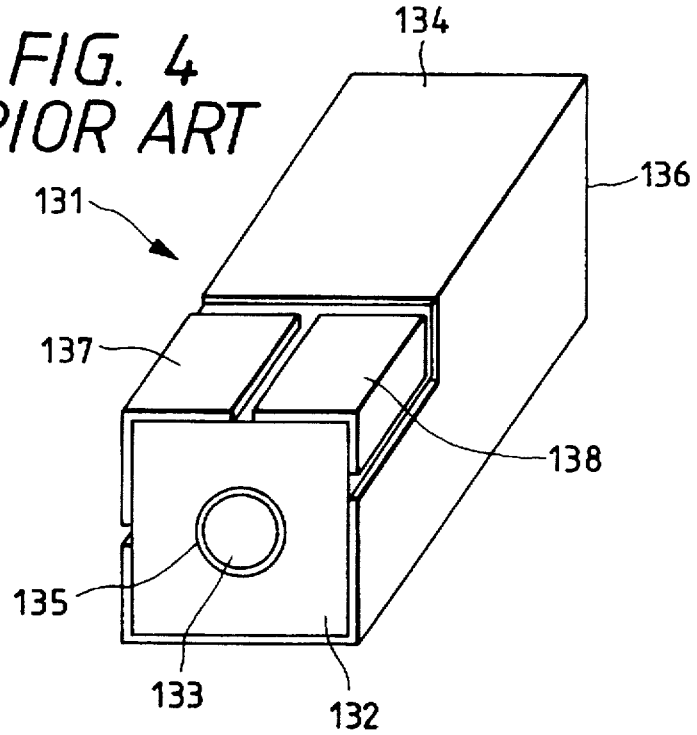
FIG. 4 PRIOR ART
FIG. 4 is a diagonal view of a conventional dielectric resonator used in a conventional band rejection filter.

The independent coupling electrode 18 is placed on the opposite side of the dielectric base 12 from the inner conductive layer 15, so that a set of the independent coupling electrode 18, the inner conductive layer 15 and the dielectric base 12 functions as a coupling capacitor having a coupling capacitance Cc which is the same as that shown in FIG. 2. Also, because the independent coupling electrode 18 is surrounded by the outer conductor cut-out groove 17, the independent coupling electrode 18 is isolated from the outer conductive layer 14, so that a set of the independent coupling electrode 18, the outer conductor cut-out groove 17 and the outer conductive layer 14 functions as a grounded capacitor having a grounded capacitance Ce which is the same as that shown in FIG. 2.

Accordingly, because the outer conductor layer cut-out groove 17 is arranged on the dielectric base 12 to isolate the independent coupling electrode 18 from the outer conductive layer 14, the dielectric resonator 11 having both functions of the coupling capacitor Cc and the grounded capacitor Ce can be obtained without adding any capacitor outside the dielectric resonator 11.

Also, because each of the outer conductive layers 14*a* to 14*c* are divided into two portions and one of the portions is placed on one end side of the opened end surface S1 of the dielectric base 12, the leakage of an electric field occurring in the dielectric resonator 11 from the opened end surface S1 of the dielectric base 12 can be prevented.

Also, one of the portions in each of the outer conductive layers 14*a* to 14*c* is placed on one end side of the opened end surface S1 of the dielectric base 12, the outer side surfaces of the dielectric base 12 are effectively occupied by the outer conductive layer 14. Therefore, a length of the dielectric resonator 11 can be shortened.

Figure 6:
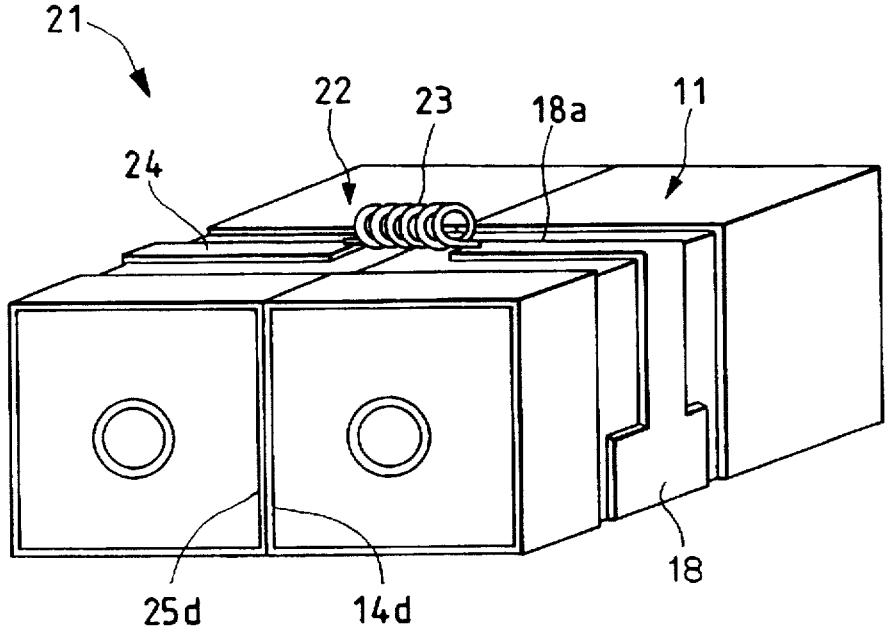
FIG. 6 is an oblique view of a band rejection filter having the dielectric resonator shown in FIG. 5A according to the first embodiment of the present invention.

FIG. 6 is an oblique view of a band rejection filter having the dielectric resonator 11 according to the first embodiment of the present invention.

As shown in FIG. 6, a band rejection filter 21 comprises the dielectric resonator 11, another dielectric resonator 22 of which the configuration is symmetrical to that of the dielectric resonator 11 with respect to a boundary plane between the dielectric resonators 11 and 22, and an air-core coil 23 connecting the independent coupling electrode 18 of the dielectric resonator 11 and an independent coupling electrode 24 of the dielectric resonator 22 symmetrical to the independent coupling electrode 18. The fourth outer conductive layer 14*d* of the dielectric resonator 11 and a fourth outer conductive layer 25*d* of the dielectric resonator 22 are connected with each other by a conductive material such as a cream-solder or a conductive adhesive to face the outer conductive layers 14*d* and 25*d* each other. In this case, any independent coupling electrode is not arranged in the boundary plane between the dielectric resonators 11 and 22. The air-core coil 23 functions as a coupling inductor having a coupling inductance Lc which is the same as that shown in FIG. 2. In this embodiment, the air-core coil 23 is used as the coupling inductor. However, it is applicable that a chip coil be used in place of the air-core coil 23.

In the above configuration, a set of the independent coupling electrode 18, the inner conductive layer 15 and the dielectric base 12 is arranged in the dielectric resonator 11, and a set of the independent coupling electrode 24, the inner conductive layer 15 and the dielectric base 12 are arranged in the dielectric resonator 22. Therefore, each of the dielectric resonators 11 and 22 has the function of the coupling capacitor Cc. Also, a set of the independent coupling electrode 18, the outer conductive layer 14 and the outer conductor layer cut-out groove 17 is arranged in the dielectric resonator 11, and a set of the independent coupling electrode 24, the outer conductive layer 14 and the outer conductor layer cut-out groove 17 is arranged in the dielectric resonator 22. Therefore, each of the dielectric resonators 11 and 22 has the function of the grounded capacitor Ce.

Accordingly, the band rejection filter 21 can be obtained without additionally arranging any coupling or grounded capacitor outside the dielectric resonators 11 and 22.

Also, because it is not required to arrange a capacitor outside the dielectric resonators 11 and 22 and one of the portions of the outer conductive layer 14 is arranged on one end side of the open end surface S1 of the dielectric base 12, the leakage of an electric field induced in each of the dielectric resonators 11 and 22 can be prevented. Therefore, the occurrence of an unnecessary coupling of the dielectric resonators 11 and 22 caused by the electric field leaking from the opened end surface of the dielectric base 12 can be reliably prevented even though either the metal chassis 121 or the metal cover 122 is not arranged in the band rejection filter 21, and the band rejection filter 21 can be easily mass-produced.

Also, because the coupling of the dielectric resonators 11 and 22 is reliably prevented, even though the rejection of an electromagnetic wave having a high frequency is required in the band rejection filter 21, an attenuation degree at the high frequency can be improved.

The coupling capacitance Cc of the coupling capacitor in the dielectric resonator 11 is adjusted by changing an area of the independent coupling electrode 18, and the grounded capacitance Ce of the grounded capacitor in the dielectric resonator 11 is adjusted by changing a width of the outer conductor layer cut-out groove 17 (or a gap between the independent coupling electrode 18 and the outer conductive layer 14). Also, the coupling capacitance Cc of the coupling capacitor in the dielectric resonator 11 is adjusted by changing a shape of the inner conductive layer 15. In the same manner, the coupling capacitance Cc of the coupling capacitor and the grounded capacitance Ce of the grounded capacitor in the dielectric resonator 22 are adjusted.

For example, in cases where a height of the dielectric resonator 11 is 3 mm, a width of the dielectric resonator 11 is 3 mm, a diameter of the penetrating hole 13 is 0.8 mm, a relative dielectric constant of the dielectric base 12 is 95, a width of each of the independent coupling electrodes 18*a* to 18*c* is 1.5 mm and a gap between the independent coupling electrode 18 and the outer conductive layer 14 is 1.2 mm, the coupling capacitance Cc of the coupling capacitor Cc is 2.5 pF, and the grounded capacitance Ce of the grounded capacitor Ce is 1.3 pF.

Figure 7:
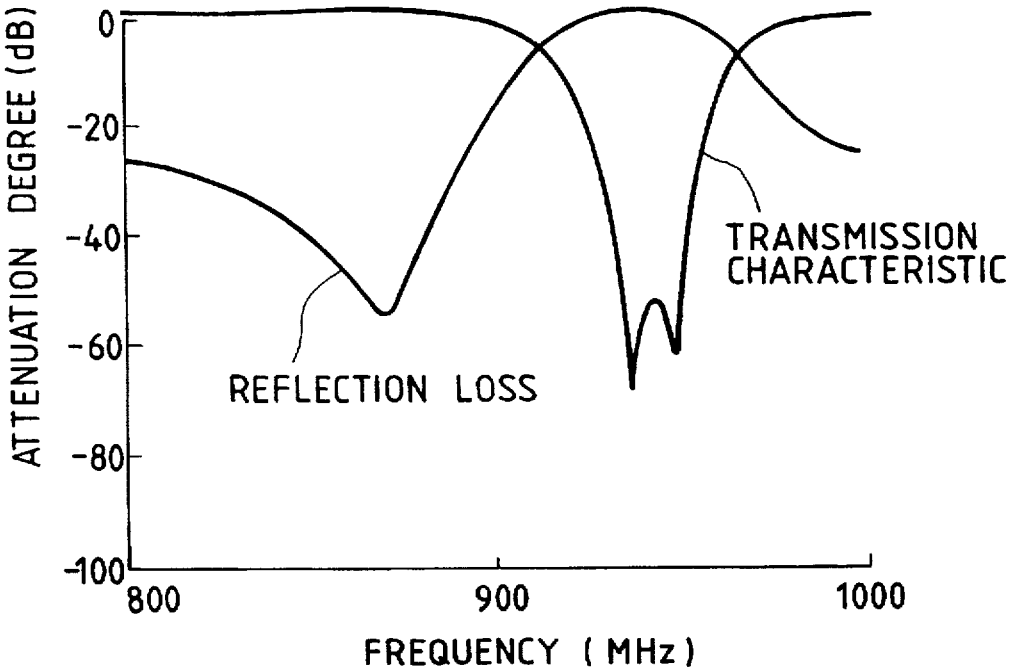
FIG. 7 shows a relationship between a frequency of an electromagnetic wave and an attenuation of the electromagnetic wave in the band rejection filter shown in FIG. 6 in case of a coupling capacitance Cc=2.5 pF, a grounded capacitance Ce=1.3 pF and a coupling inductance Lc=7 nH.

FIG. 7 shows a relationship between a frequency of an electromagnetic wave and an attenuation of the electromagnetic wave in the band rejection filter 21 in case of the coupling capacitance Cc=2.5 pF, the grounded capacitance Ce=1.3 pF and the coupling inductance Lc=7 nH. A frequency characteristic (or a transmission characteristic) of the electromagnetic wave transmitting through the band rejection filter 21 and a reflection loss of the electromagnetic wave reflected by the band rejection filter 21 are shown.

As shown in FIG. 7, the frequency of the electromagnetic wave in a pass band ranges from 860 to 880 MHz because the degree of the reflection loss is low, and an attenuation of the electromagnetic wave in the range from 935 to 950 MHz is −54 dB or more attenuation degree.

Accordingly, because the independent coupling electrode 18 is arranged on the dielectric base 12 to be surrounded by the outer conductor layer cut-out groove 17, the band rejection filter 21 can effectively function to reject the electromagnetic wave ranging from 935 to 950 MHz and pass the electromagnetic wave ranging from 860 to 880 MHz.

Also, the coupling capacitance Cc and the grounded capacitance can be adjusted in the band rejection filter 21.

Figure 8:
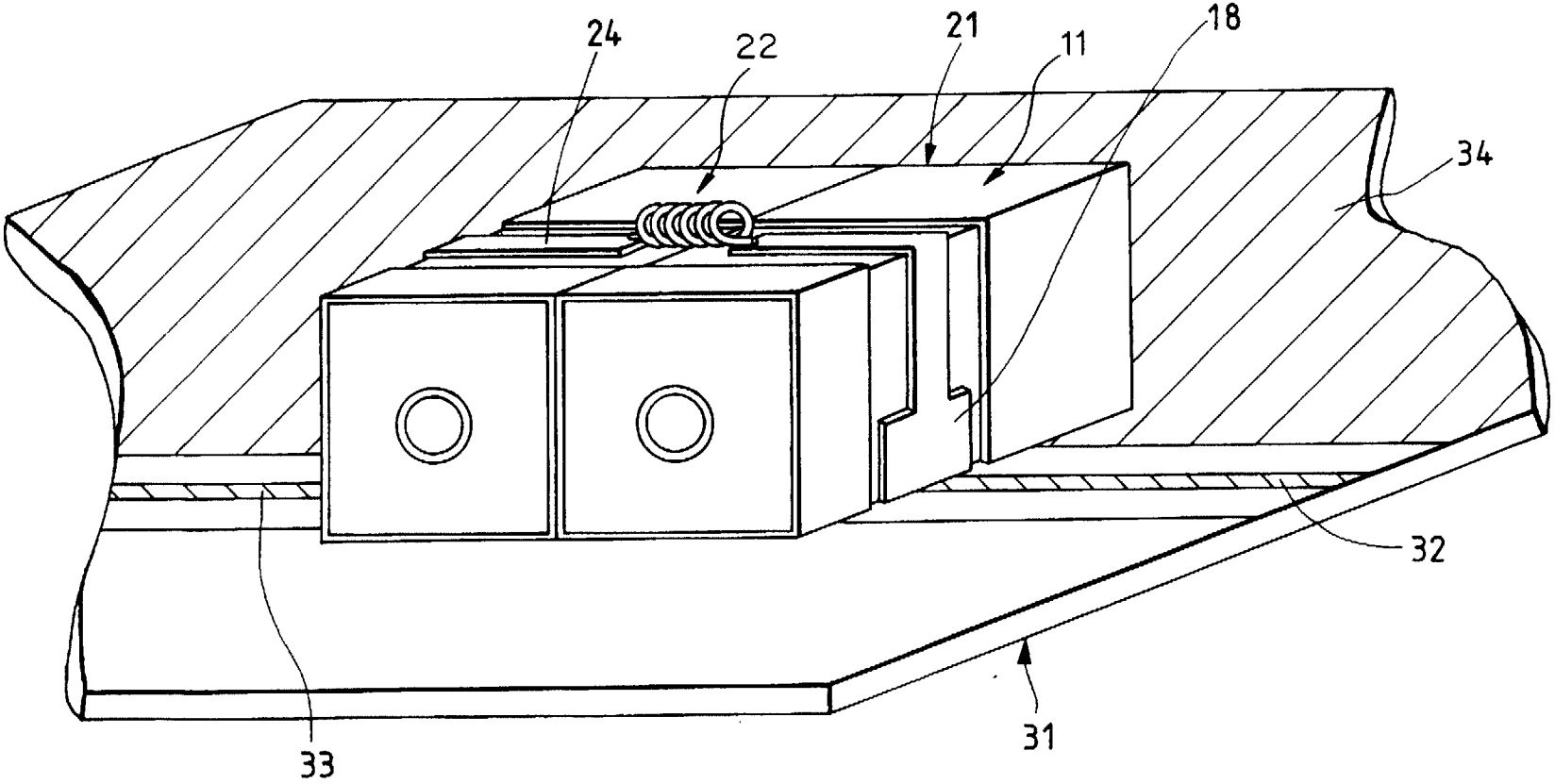
FIG. 8 is an oblique view of the band rejection filter arranged on a printed board.

FIG. 8 is an oblique view of the band rejection filter 21 arranged on a printed board.

As shown in FIG. 8, a printed board 31 is made of an insulating material such as glass or epoxy resin, an input line 32 and an output line 33 are arranged on the printed board 31, and a grounded line 34 is arranged on the printed board 31. The input line 32 is connected with the independent coupling electrode 18 of the dielectric resonator 11 by a conductive element such as a solder, and the output line 33 is connected with the independent coupling electrode 24 of the dielectric resonator 22. Also, the grounded line 34 is connected with the third outer conductive layers of the dielectric resonators 11 and 22 by a conductive element such as a solder.

Figure 9:
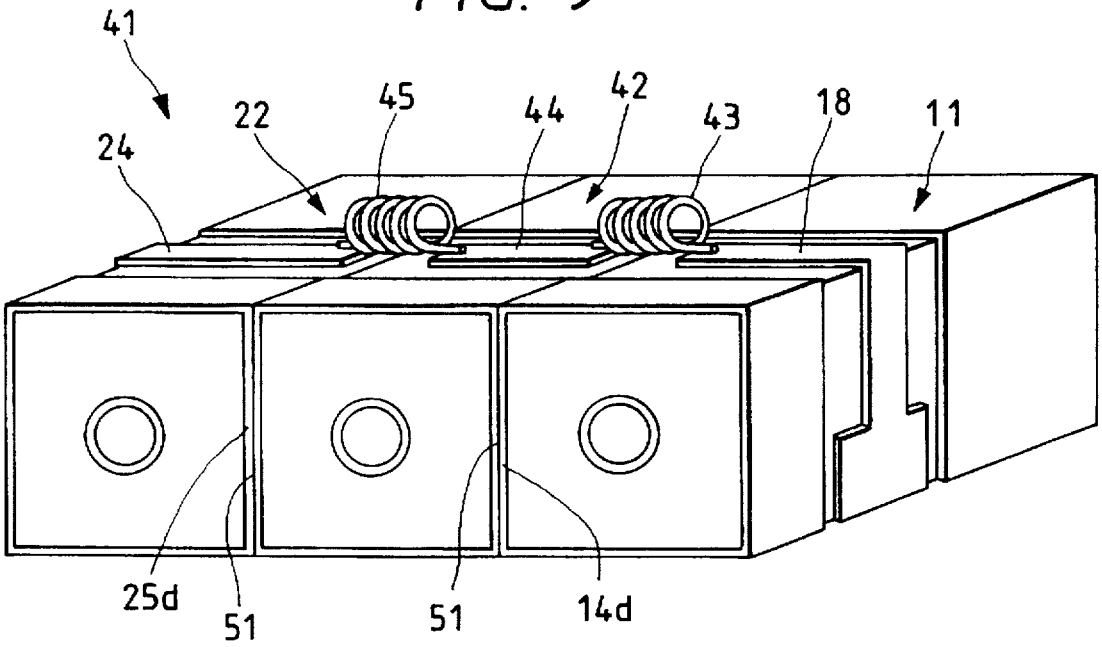
FIG. 9 is an oblique view of another band rejection filter according to the first embodiment of the present invention.
Figure 10:
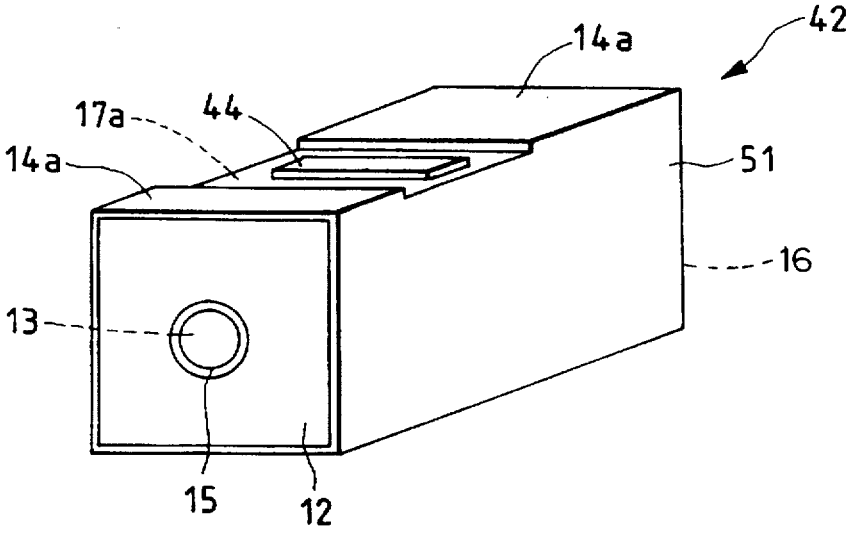
FIG. 10 is an oblique view of a dielectric resonator used in the band rejection filter shown in FIG. 9.

FIG. 9 is an oblique view of another band rejection filter having the dielectric resonator 11 according to the first embodiment of the present invention, and FIG. 10 is an oblique view of a dielectric resonator used in the band rejection filter shown in FIG. 9.

As shown in FIG. 9, a band rejection filter 41 comprises the dielectric resonator 11, the dielectric resonator 22, a dielectric resonator 42 arranged between the dielectric resonators 11 and 22, a first air-core coil 43 connecting the independent coupling electrode 18 of the dielectric resonator 11 and an independent coupling electrode 44 of the dielectric resonator 42, and a second air-core coil 45 connecting the independent coupling electrode 44 of the dielectric resonator 42 and the independent coupling electrode 24 of the dielectric resonator 22. As shown in FIG. 10, the dielectric resonator 42 comprises the dielectric base 12 having the penetrating hole 13, the first outer conductive layer 14*a*, a second outer conductive layer 51 arranged on three side surfaces of the dielectric base 12 and connected with the first outer conductive layer 14*a*, the inner conductive layer 15, the connecting conductive layer 16 arranged on one end surface of the dielectric base 12 for connecting the inner conductive layer 15 and the outer conductive layers 14*a* and 51, and the independent coupling electrode 44 arranged on the dielectric base 12 to be surrounded by the first outer conductor layer cut-out groove 17*a*. Because the independent coupling electrode 44 is placed on the opposite side of the dielectric base 12 from the inner conductive layer 15, so that a set of the independent coupling electrode 44, the inner conductive layer 15 and the dielectric base 12 functions as a coupling capacitor having a coupling capacitance Cc which is the same as that shown in FIG. 2. Also, the independent coupling electrode 44 is placed on the opposite side of the outer conductor layer cut-out groove 17*a* from the first outer conductive layer 14*a*, so that a set of the independent coupling electrode 44, the first outer conductor layer cut-out groove 17*a* and the first outer conductive layer 14*a* functions as a grounded capacitor Ce having a grounded capacitance Ce which is the same as that shown in FIG. 2.

Returning to FIG. 9, the fourth outer conductive layer 14*d* of the dielectric resonator 11 is connected with the second outer conductive layer 51 of the dielectric resonator 42 so that the outer conductive layers 14*d* and 51 face each other, and the fourth outer conductive layer 25*d* of the dielectric resonator 22 is connected with the second outer conductive layer 51 of the dielectric resonator 42 so that the outer conductive layers 51 and 25*d* face each other.

In the above configuration, a set of the independent coupling electrode 18, the inner conductive layer 15 and the dielectric base 12 is arranged in the dielectric resonator 11, a set of the independent coupling electrodes 18*b*, 18*c* and 24, the inner conductive layer 15 and the dielectric base 12 are arranged in the dielectric resonator 22, and a set of the independent coupling electrode 44, the inner conductive layer 15 and the dielectric base 12 is arranged in the dielectric resonator 42. Therefore, each of the dielectric resonators 11, 22 and 42 functions as the coupling capacitor Cc.

Also, a set of the independent coupling electrode 18, the outer conductive layer 14 and the outer conductor layer cut-out groove 17 is arranged in the dielectric resonator 11, a set of the independent coupling electrodes 24, the outer conductive layer 14 and the outer conductor layer cut-out groove 17 is arranged in the dielectric resonator 22, and a set of the independent coupling electrode 44, the outer conductive layer 14 and the outer conductor layer cut-out groove 17 is arranged in the dielectric resonator 42. Therefore, each of the dielectric resonators 11, 22 and 42 functions as the grounded capacitor Ce.

Figure 3:
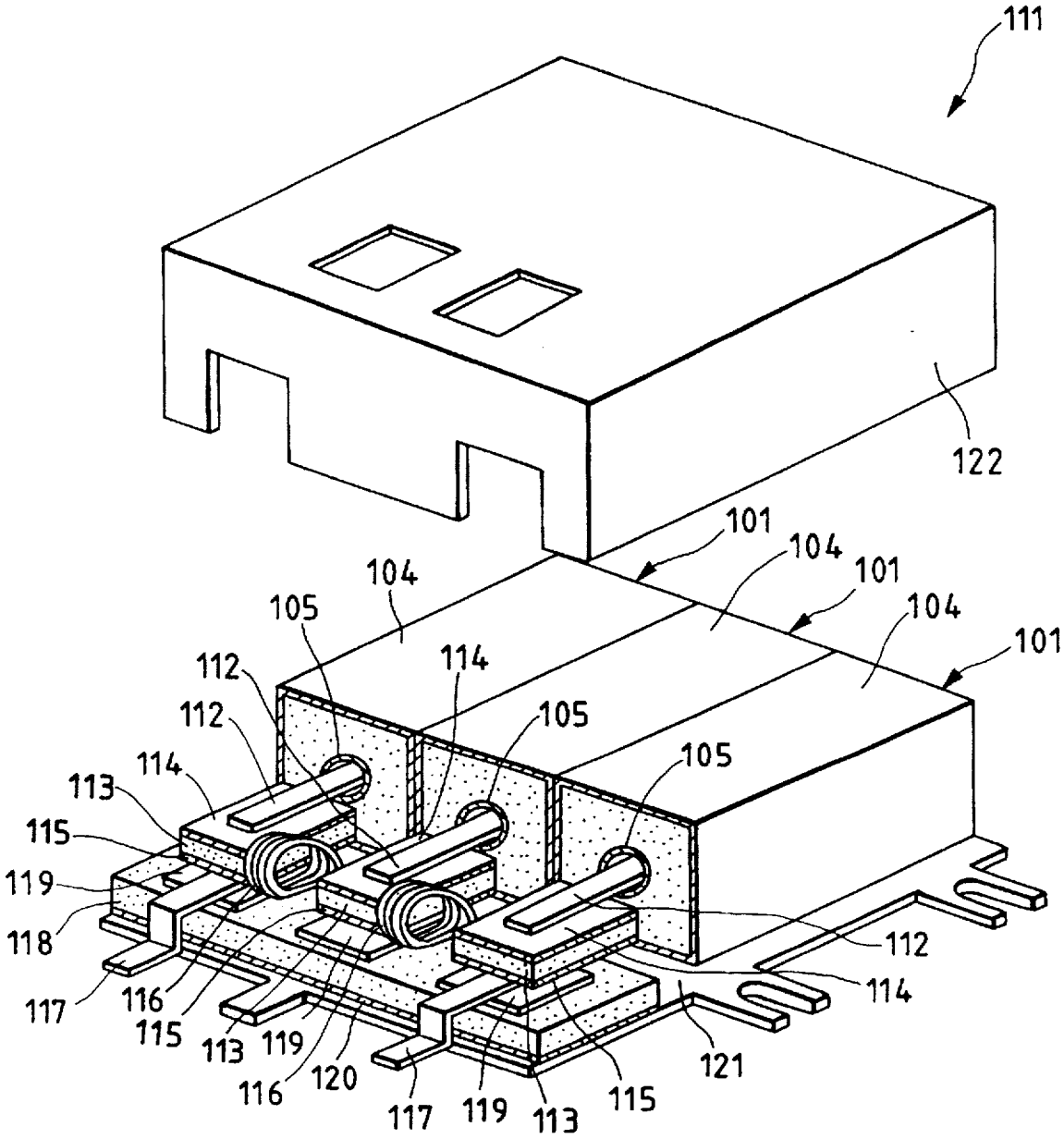
FIG. 3 PRIOR ART
FIG. 3 is an exploded oblique view of a conventional band rejection filter.

Accordingly, an equivalent circuit of the band rejection filter 41 agreeing with that shown in FIG. 2 can be obtained without additionally arranging any coupling or grounded capacitor outside the dielectric resonators 11, 22 and 42. Because any of the elements 112 to 122 shown in FIG. 3 is not required, the band rejection filter 41 can be easily manufactured at a low cost, and the band rejection filter 41 can be manufactured in a small size.

Figure 11A:
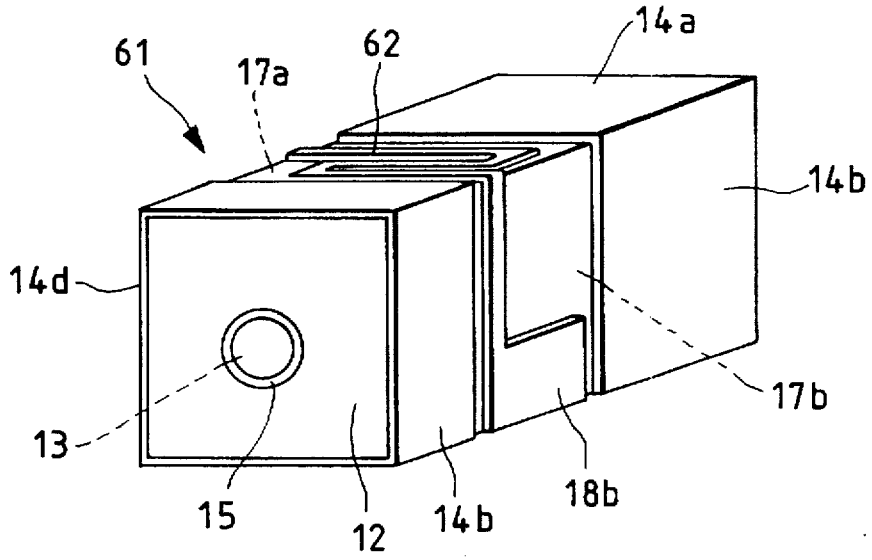
FIG. 11A is a diagonal view of a dielectric resonator according to a second embodiment of the present invention.
Figure 11B:
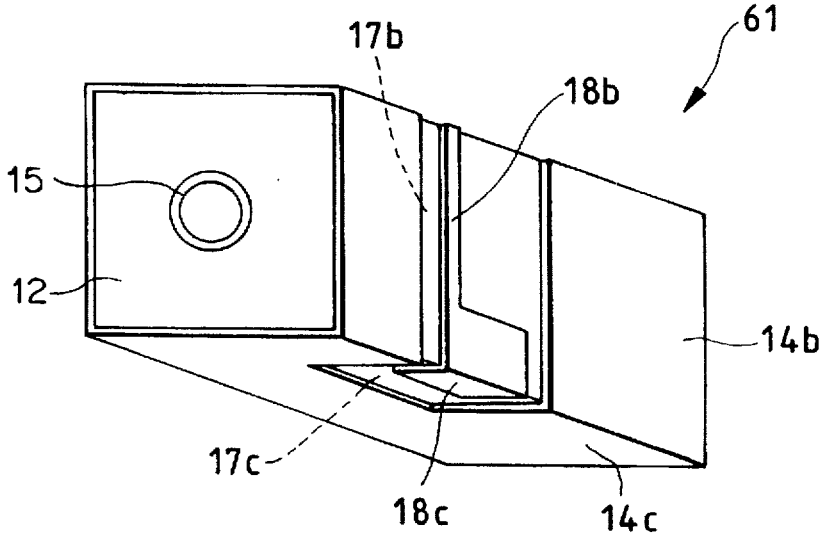
FIG. 11B is another diagonal view of the dielectric resonator shown in FIG. 11A.

FIG. 11A is a diagonal view of a dielectric resonator according to a second embodiment of the present invention. The dielectric resonator is viewed from an upper point. FIG. 11B is another diagonal view of the dielectric resonator shown in FIG. 11A. The dielectric resonator is viewed from a lower point.

As shown in FIGS. 11A and 11B, a dielectric resonator 61 comprises the dielectric base 12 having the penetrating hole 13, the outer conductive layer 14, the inner conductive layer 15, the connecting conductive layer 16, the independent coupling electrodes 18*b* and 18*c*, and a first independent coupling electrode 62 (see FIG. 11A) arranged on the first outer side surface of the dielectric base 12 and connected with the independent coupling electrodes 18*b* and 18*c* (see FIG. 11B). The first independent coupling electrode 62 is composed of a narrow line in which a plurality of straight portions are closely arranged in parallel to each other in the first outer conductor layer cut-out groove 17*a* (see FIG. 11A). Therefore, the first independent coupling electrode 62 functions as an inductor. Also, a set of the independent coupling electrodes 18*b* and 18*c*, the dielectric base 12 and the inner conductive layer 15 functions as a coupling capacitor having a coupling capacitance Cc which is the same as that shown in FIG. 2. Also, a set of the independent coupling electrodes 18*b* and 18*c*, the outer conductor layer cut-out groove 17 and the outer conductive layer 14 functions as a grounded capacitor having a grounded capacitance Ce which is the same as that shown in FIG. 2.

The coupling capacitance Cc of the coupling capacitor in the dielectric resonator 61 is adjusted by changing an area of the independent coupling electrodes 18*b* and 18*c*, and the grounded capacitance Ce of the grounded capacitor in the dielectric resonator 11 is adjusted by changing a width of the outer conductor layer cut-out groove 17 (or a gap between the independent coupling electrode 18 and the outer conductive layer 14). Also, the coupling capacitance Cc of the coupling capacitor in the dielectric resonator 61 is adjusted by changing a shape of the inner conductive layer 15.

Figure 12:
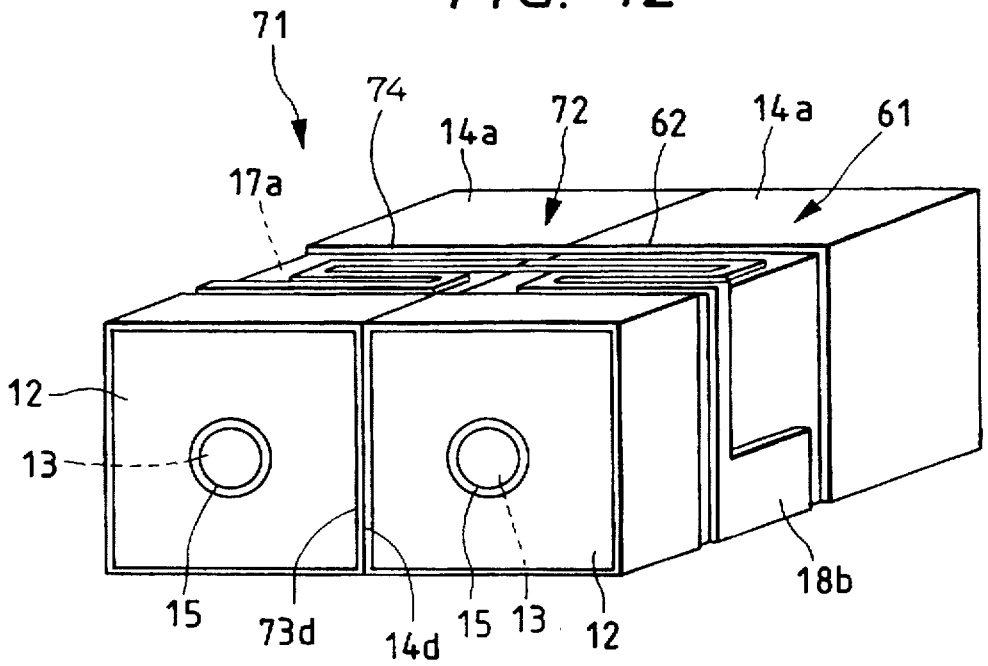
FIG. 12 is an oblique view of a band rejection filter having the dielectric resonator shown in FIGS. 11A and 11B according to the second embodiment of the present invention.

FIG. 12 is an oblique view of a band rejection filter having the dielectric resonator 61 according to the second embodiment of the present invention.

As shown in FIG. 12, a band rejection filter 71 comprises the dielectric resonator 61, another dielectric resonator 72 of which the configuration is symmetrical to that of the dielectric resonator 61 with respect to a boundary plane between the dielectric resonators 61 and 72. The fourth outer conductive layer 14*d* of the dielectric resonator 61 and a fourth outer conductive layer 73*d* of the dielectric resonator 72 are connected with each other by a conductive material such as a cream-solder or a conductive adhesive thereby to face the outer conductive layers 14*d* and 73*d* to each other. In this case, any independent coupling electrode is not arranged in the boundary plane between the dielectric resonators 61 and 72. Also, one end of the first independent coupling electrode 62 of the dielectric resonator 61 is connected with one end of a first independent coupling electrode 74 of the dielectric resonator 72 by the conductive material.

Therefore, the first independent coupling electrode 62 and the first independent coupling electrode 74, which are serially connected with each other, function as a coupling inductor having an inductance Lc which is the same as that shown in FIG. 2.

The inductance Lc of a set of the first independent coupling electrodes 62 and 74 is adjusted by changing the length of each of the first independent coupling electrodes 62 and 74.

Accordingly, because the first independent coupling electrodes 62 and 74 are arranged in the band rejection filter 71, an equivalent circuit of the band rejection filter 71 agreeing with that shown in FIG. 2 can be obtained without additionally arranging an inductor outside the dielectric resonances 61 and 72. Therefore, the band rejection filter 71 can be easily manufactured at a low cost, and the band rejection filter 41 can be manufactured in a small size.

Having illustrated and described the principles of the present invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A band rejecting filter comprising a plurality of dielectric resonators, including at least one pair of adjacent dielectric resonators adjacent to each other, said plurality of dielectric resonators arranged in parallel to each other, and including at least one inductor element connecting said pair of adjacent dielectric resonators, each of the dielectric resonators comprising:

a dielectric base having a penetrating hole, the dielectric base having an outer side surface, an inner side surface, a first end surface and a second end surface;

an outer conductive layer arranged on the outer side surface of the dielectric base, the outer conductive layers of each pair of adjacent dielectric resonators being electrically connected with each other;

an inner conductive layer arranged on the inner side surface of the dielectric base to surround the penetrating hole;

a connecting conductive layer arranged on the first end surface of the dielectric base for connecting the outer conductive layer and the inner conductive layer, the second end surface of the dielectric base being exposed to form an open end;

an outer conductor layer cut-out groove arranged on the outer side surface of the dielectric base to expose a part of the outer side surface of the dielectric base on which the outer conductive layer is not arranged, the outer conductor layer cut-out groove being surrounded by the outer conductive layer, and a region adjacent the open end of the dielectric base being totally surrounded by an end portion of the outer conductive layer; and an independent coupling electrode arranged on the outer side surface of the dielectric base to be surrounded by the outer conductor layer cut-out groove so that the independent coupling electrode is not connected with the outer conductive layer, the independent coupling electrodes of each pair of adjacent dielectric resonators being connected with each other through a respective inductor element.

2. A band rejecting filter according to claim 1 in which the dielectric base of each of the dielectric resonators is shaped as a rectangular prism having four outer sides corresponding to said outer side surface, and the independent coupling electrode of each of the dielectric resonators being on one of the four outer sides of the dielectric base.

3. A band rejecting filter according to claim 1 including a first dielectric resonator located at one end of the plurality of dielectric resonators, a second dielectric resonator located at the other end of the plurality of parallel aligned dielectric resonators, in which the independent coupling electrode of the first dielectric resonator is connected with an input line to which a signal is input, and the independent coupling electrode of the second dielectric resonator is connected with an output line from which the signal is output.

4. A band rejecting filter according to claim 3 in which said first and second dielectric resonators have structures that have plane symmetry with respect to each other.

5. A band rejecting filter according to claim 1 in which said pair of adjacent dielectric resonators includes first and second dielectric resonators of said plurality of dielectric resonators, the independent coupling electrodes of the first and second dielectric resonators each have a respective conductive line, and the conductive lines of the first and second dielectric resonators are connected with each other through the corresponding inductor element having a narrow line in which a plurality of straight portions are closely arranged in parallel to each other.

6. A band rejecting filter according to claim 5 in which said first and second dielectric resonators have structures that are planely symmetric with respect to each other.

7. A band rejecting filter according to claim 1 in which the dielectric base of each dielectric resonator is shaped as a rectangular prism having four outer sides corresponding to the outer side surface thereof and two ends corresponding to the first and second end surfaces thereof, the plurality of dielectric resonators include at least three dielectric resonators, the plurality of dielectric resonators include first and second types of dielectric resonators, said first type of dielectric resonator including two end dielectric resonators arranged on both ends of the plurality of dielectric resonators and said second type of dielectric resonator including at least one intermediate dielectric resonator placed between the end dielectric resonators, the outer conductor layer cut-out groove and the independent coupling electrode in each of the end dielectric resonators are arranged on three outer sides of the respective dielectric base thereof, none of said three outer sides of the dielectric base of the end dielectric resonators facing an intermediate dielectric resonator adjacent thereto, and the outer conductor layer cut-out groove and the independent coupling electrode in each intermediate dielectric resonator are arranged only on one outer side of the dielectric base thereof, said one outer side of the dielectric base of an intermediate dielectric resonator does not face another intermediate dielectric resonator or an end dielectric resonator adjacent thereto.

8. A band rejecting filter according to claim 1 in which each of the inductor elements is either an air-core coil or a chip coil.

* * * * *